US011397399B2

(12) United States Patent
Kim

(10) Patent No.: US 11,397,399 B2
(45) Date of Patent: Jul. 26, 2022

(54) CLEANING MEMBER WITH ENDS OF BLADE THEREOF BENT TOWARD IMAGE CARRIER

(71) Applicant: Hewlett-Packard Development Company, L.P., Spring, TX (US)

(72) Inventor: Wonkook Kim, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/416,902

(22) PCT Filed: May 19, 2020

(86) PCT No.: PCT/US2020/033539
§ 371 (c)(1),
(2) Date: Jun. 21, 2021

(87) PCT Pub. No.: WO2020/256874
PCT Pub. Date: Dec. 24, 2020

(65) Prior Publication Data

US 2022/0100140 A1 Mar. 31, 2022

(30) Foreign Application Priority Data

Jun. 17, 2019 (KR) ..... 10-2019-0071645

(51) Int. Cl.
*G03G 15/16* (2006.01)
*G03G 21/00* (2006.01)

(52) U.S. Cl.
CPC ..... *G03G 21/0029* (2013.01); *G03G 15/161* (2013.01); *G03G 2215/1661* (2013.01)

(58) Field of Classification Search
CPC ..... G03G 15/161; G03G 2215/1661; G03G 21/0011; G03G 21/0029
USPC ..... 399/101, 350, 351
See application file for complete search history.

(56) References Cited

U.S. PATENT DOCUMENTS

| | | | | |
|---|---|---|---|---|
| 10,168,656 | B2 * | 1/2019 | Meguro | G03G 21/0011 |
| 10,725,402 | B2 * | 7/2020 | Ishizumi et al. | G03G 15/161 |
| 2015/0331384 | A1 * | 11/2015 | Kato | G03G 21/00 399/350 |

FOREIGN PATENT DOCUMENTS

| | | | |
|---|---|---|---|
| JP | 1993333753 | | 12/1993 |
| JP | 1995104626 | | 2/1995 |
| JP | 2001228767 | | 8/2001 |
| JP | 2007248628 | | 9/2007 |
| JP | 2011085634 | A | 4/2011 |
| JP | 2011137988 | A | 7/2011 |
| JP | 2012027170 | A | 2/2012 |
| JP | 2016177199 | | 10/2016 |
| KR | 20080070166 | A | 7/2006 |

* cited by examiner

*Primary Examiner* — William J Royer
(74) *Attorney, Agent, or Firm* — Jefferson IP Law, LLP

(57) ABSTRACT

An image forming apparatus includes an image carrier, a developing device that supplies a toner to the image carrier, and a cleaning member. The cleaning member includes a blade that contacts the image carrier and applies a pressure onto the image carrier. The blade has two ends that are bent in a direction toward the image carrier, wherein the blade forms cleaning angles with the image carrier at the two ends of the blade, that are smaller than cleaning angles formed with the image carrier in other portions of the blade.

15 Claims, 7 Drawing Sheets

CLEANING MEMBER WITH ENDS OF BLADE THEREOF BENT TOWARD IMAGE CARRIER

BACKGROUND

An image forming apparatus may be an apparatus that develops a black and white image or a color image on paper according to an image signal. Examples of an image forming apparatus, include laser printers, inkjet printers, copying machines, multi-function printers, facsimiles, etc.

In an electrophotographic image forming apparatus, a visible toner image is generated from an electrostatic latent image by attaching toner to a photosensitive drum or an intermediate transfer belt on which the electrostatic latent image is formed, and transferring the toner image onto paper.

DETAILED DESCRIPTION

In the following description, with reference to the drawings, the same reference numbers are assigned to the same components or to similar components having the same function, and overlapping description is omitted.

In the present disclosure, the expression "connected to", for example when one element is described as being "connected to" another element, may refer to both a case where the one element is 'directly connected to' the other element, and a case where one element is 'connected to another element through another element' (e.g., connected indirectly). In addition, the expression "includes", for example when one element "includes" another element, may refer to a state where other elements may additionally be included, without excluding other elements unless there is any specific description to the contrary.

In the present disclosure, the term "image forming job" may refer to various jobs (e.g., printing, scanning or faxing) related to images and imaging, such as formation of images or generation/storing/transmission of image files, etc., for example. In addition, the term "job" may refer to an image forming job, and may also include all of a series of processes and operations for performing an image forming job.

In addition, the term "image forming apparatus" may refer to an apparatus or device that prints printing data generated at a terminal apparatus such as a computer for example, onto paper or recording paper. As examples of such an image forming apparatus, there are copying machines, printers, facsimiles or multi-function printers (MFPs) that implement multiple functions of the aforementioned apparatuses through one apparatus, etc. In addition, an image forming apparatus may refer to any apparatus capable of performing image forming jobs such as printers, fax machines, multi-function printers (MFPs) or display apparatuses, etc.

In addition, the term "user" may refer to a person who performs operations related to an image forming job by using an image forming apparatus, or a device connected to an image forming apparatus through wire or wirelessly.

Figure 1:
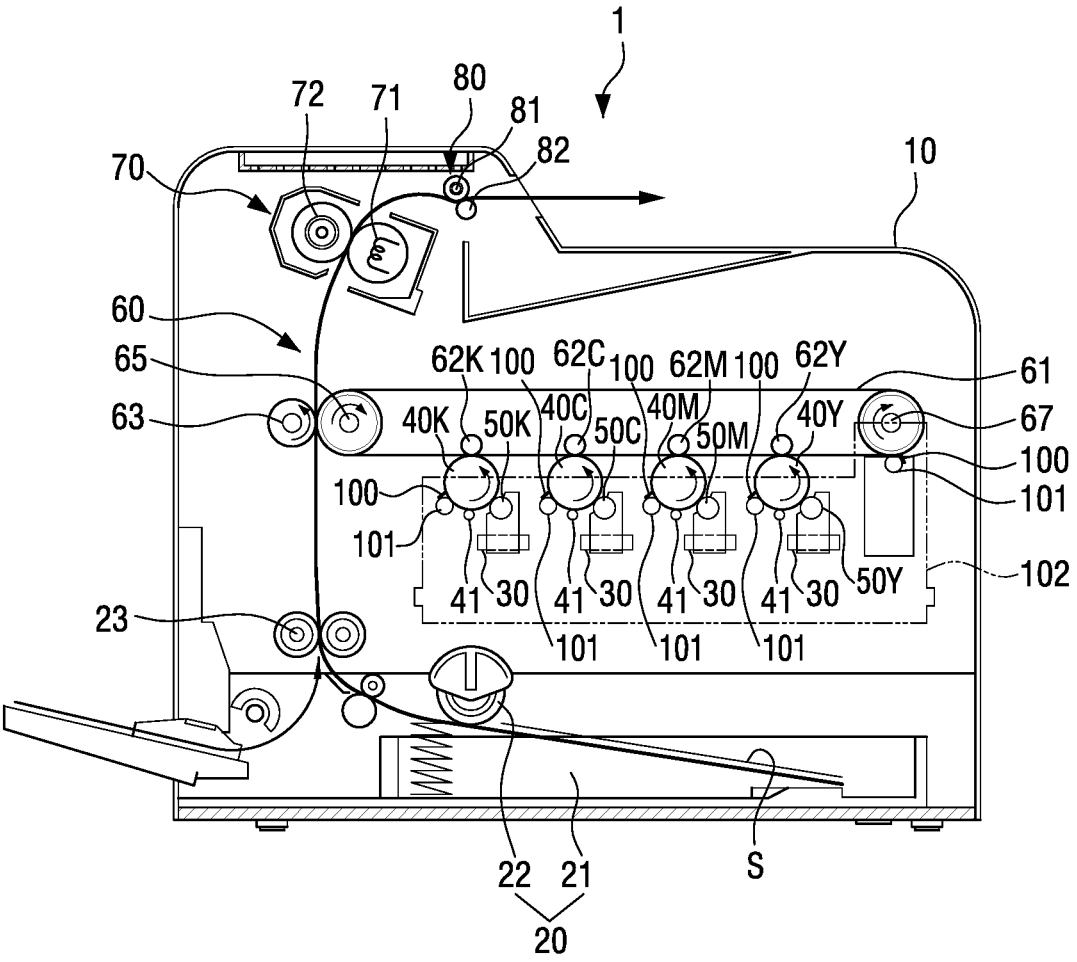
FIG. 1 is a schematic diagram illustrating an example configuration of an example image forming apparatus.

FIG. 1 is a diagram illustrating a schematic configuration of an example image forming apparatus 1.

As illustrated in FIG. 1, the example image forming apparatus 1 may include a main body 10, a paper supply apparatus 20, an exposure apparatus 30, a photosensitive drum, a developing device, a transferring apparatus 60, a fuser 70, and a paper eject apparatus 80.

The main body 10 may form the exterior of the image forming apparatus 1, and may house and/or support various components installed inside the image forming apparatus 1.

The paper supply apparatus 20 supplies paper S (e.g., sheets of paper S) toward the transferring apparatus 60. The paper supply apparatus 20 may include a cassette 21 storing the paper S, a pick-up roller 22 that picks up the paper S stored in the cassette 21 one at a time, and a feed roller 23 that feeds the picked-up paper S toward the transferring apparatus 60.

The exposure apparatus 30 may be arranged in a lower part of the developing device, and may project light corresponding to image information on the photosensitive drum, and thereby form an electrostatic latent image on the surface of the photosensitive drum.

The photosensitive drum includes a metal drum having a cylindrical shape, and a light conductive layer formed on the outer circumference of the metal drum. The photosensitive drum is an image carrier that carries an electrostatic latent image formed by the exposure apparatus 30 and a toner image formed by the developing device. The photosensitive drum may be rotatably installed inside the main body 10.

A charge roller 41 is installed within (inside) the main body 10. The charge roller 41 charges the photosensitive drum to a predetermined potential before the exposure apparatus 30 projects light onto the photosensitive drum. The charge roller 41 may be a charge device that charges the photosensitive drum to a uniform potential. The charge roller 41 may provide electric charges while rotating in a contact or non-contact state with the outer circumferential surface of the photosensitive drum, and thereby charge the outer circumferential surface of the photosensitive drum to a uniform potential.

The developing device forms a toner image by supplying a toner (e.g., a developing agent) to the photosensitive drum on which an electrostatic latent image was formed. The developing device may include four developing devices 50K, 50C, 50M, 50Y wherein toners in different colors, for example, toners in black (K), cyan (C), magenta (M), and yellow (Y) colors are respectively accommodated.

In each of the developing devices 50K, 50C, 50M, 50Y, a toner to be supplied to each photosensitive drum 40K, 40C, 40M, 40Y is stored, and a toner image may be formed by attaching the stored toners to the surface of the photosensitive drum on which an electrostatic latent image was formed.

The transferring apparatus 60 may include an intermediate transfer belt 61 and an intermediate transfer roller.

The intermediate transfer belt 61 also may be an image carrier that carries a toner image formed by the developing device.

The intermediate transfer belt 61 may be supported by a driving roller 65 and a driven roller 67 and may run at the same speed as the line speed of the photosensitive drum. The length of the intermediate transfer belt 61 may be formed to be the same as or at least longer than the length of the paper S (sheet of paper) used for the image forming apparatus 1.

In each of the developing devices 50K, 50C, 50M, 50Y, the intermediate transfer roller faces the photosensitive drum with the intermediate transfer belt 61 in between, and transfers a toner image formed on the facing photosensitive drum onto the intermediate transfer belt 61. There may be a plurality of intermediate transfer rollers 62K, 62C, 62M, 62Y to correspond to the plurality of photosensitive drums 40K, 40C, 40M, 40Y. A first transfer bias voltage for transferring a toner image formed on the photosensitive drum to the intermediate transfer belt 61 is applied to the intermediate transfer roller. The first transfer bias voltage is a voltage having a polarity that is opposite (an opposite polarity) to the polarity of toner. When the first transfer bias voltage is applied to the intermediate transfer roller, the toner image formed on the surface of the photosensitive drum is transferred to the intermediate transfer belt 61. Accordingly, the toner images formed on each of the photosensitive drums 40K, 40C, 40M, 40Y may be sequentially transferred onto the intermediate transfer belt 61 in an overlapping manner (e.g., the toner images are superimposed or layered), to form a composite toner image (e.g., a first transfer image).

Also, the transferring apparatus 60 may include a final transfer roller 63. The final transfer roller 63 may face the driving roller 65 with the intermediate transfer belt 61 in between.

The final transfer roller 63 may be spaced apart from the intermediate transfer belt 61 while an image is being transferred from the photosensitive drum to the intermediate transfer belt 61, and when the image on the photosensitive drum is fully transferred to the intermediate transfer belt 61, the final transfer roller 63 may contact the intermediate transfer belt 61 at a predetermined pressure. When the final transfer roller 63 contacts the intermediate transfer belt 61, the composite toner image carried on the intermediate transfer belt 61 may be transferred onto paper S. In order to transfer the toner image onto the sheet of paper S, a second transfer bias voltage may be applied onto the final transfer roller 63.

When the second transfer bias voltage is applied to the final transfer roller 63, the composite toner image (the first transfer image) formed on the intermediate transfer belt 61 is transferred to the paper S transferred by the paper supply apparatus 20 as a second transfer image.

In a process wherein a toner image is transferred to the photosensitive drum, then to the intermediate transfer belt 61, and then to the paper, for example as described above, some toners (e.g., toner particles) may remain on the image carrier (the photosensitive drum or the intermediate transfer belt 61), and become waste toners. The image forming apparatus may include a cleaning member 100, to remove waste toners (e.g., excess toner particles or residual toner particles) that remain on the photosensitive drum and/or on the intermediate transfer belt 61 in preparation for printing onto a next sheet of paper.

The cleaning member 100 may be arranged to contact each of the photosensitive drums 40K, 40C, 40M, 40Y and the intermediate transfer belt 61. The cleaning member 100 may contact the image carrier (the photosensitive drum or the intermediate transfer belt 61) while applying a predetermined pressure thereto, to remove toner particles that remain on the photosensitive drums 40K, 40C, 40M, 40Y or the intermediate transfer belt 61 without having been transferred with the toner image.

The cleaning member 100 removes residual toner particles (waste toners) that remain on the outer circumferential surface of the photosensitive drum or the intermediate transfer belt 61 after transferring to the paper S has been performed by physical scraping.

The residual toner particles (waste toners) removed from the photosensitive drums 40K, 40C, 40M, 40Y and the intermediate transfer belt 61 by the cleaning member 100, are transferred in a conveyance direction by rotation of a waste toner transfer auger 101 in the form of a screw, and the transferred waste toners may be collected at a waste toner collecting device 102. For example, the waste toner transfer auger 101 may extend in a direction that is parallel to a rotational axis of the photosensitive drums 40K, 40C, 40M, 40Y or of the driven roller 67, and which defines the conveyance direction.

The cleaning member 100 will be described in more detail further below.

The fuser 70 includes a heating roller 71 having a heat source, and a pressure roller 72 installed in an opposite direction to the heating roller 71. When the paper S passes between the heating roller 71 and the pressure roller 72, the toner image may be fixed onto the paper S by heat transferred from the heating roller 71 and pressure that operates between the heating roller 71 and the pressure roller 72.

The paper eject apparatus 80 may include a paper eject roller 81 and a paper eject back-up roller 82, and may eject the paper S that passed through the fuser 70 to the outside of the main body 10.

Meanwhile, in illustrating and explaining FIG. 1, it was illustrated and explained that the image forming apparatus 1 includes a plurality of developing devices and photosensitive drums, and an intermediate transfer belt for color printing. In some examples, for example in an image forming apparatus that performs monochrome printing (e.g., an image forming apparatus that is limited to supporting black and white printing), there may be a single developing device and a single photosensitive drum, and an intermediate transfer belt may be omitted.

Figure 2:
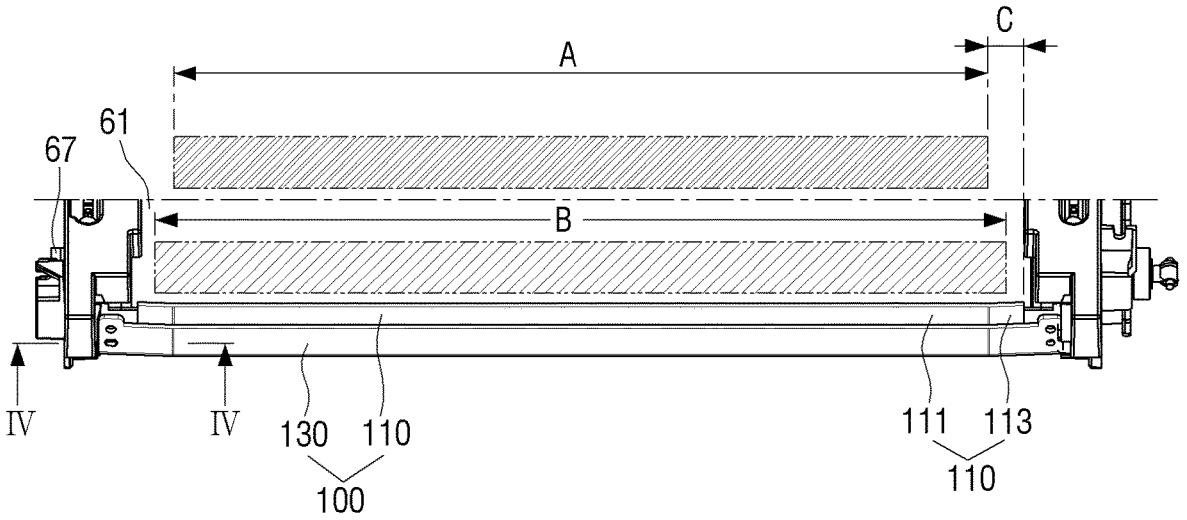
FIG. 2 is a front view of an example cleaning member and an example intermediate transfer belt.

FIG. 2 is a front view illustrating a state wherein a cleaning member contacts an intermediate transfer belt 61 according to an example of the disclosure.

Referring to FIG. 2, the cleaning member 100 may be arranged to contact an image carrier 61.

The image carrier 61 may carry an electrostatic latent image formed by the exposure apparatus 30 and/or a toner image formed by the developing device. FIG. 2 illustrates an example wherein the image carrier is the intermediate transfer belt 61 that carries the toner image. In some examples, the image carrier may also be a photosensitive drum.

The configuration of the cleaning member 100 that removes waste toners from the photosensitive drum and the configuration of the cleaning member 100 that removes waste toners from the intermediate transfer belt 61 may be similar. Thus, for ease of understanding, the description of the cleaning member 100 arranged to contact the photosensitive drum is interchangeable with description of the cleaning member 100 arranged to contact the intermediate transfer belt 61.

When a toner image is transferred to the intermediate transfer belt 61 or to the paper S in the printing process of the image forming apparatus 1, some toners (toner particles) may remain on the photosensitive drum or the intermediate transfer belt 61. Toners that remain on the photosensitive drum or the intermediate transfer belt 61 as described above become waste toners (e.g., excess toner particles or residual toner particles). Such waste toners may be removed by the cleaning member 100 that frictionally contacts the photosensitive drum or the intermediate transfer belt 61.

The cleaning member 100 may be arranged to be adjacent to one side of the intermediate transfer belt 61. For example, the cleaning member 100 may be arranged in a cleaning position which is a location within a predetermined distance from the intermediate transfer belt 61.

The cleaning member 100 may include a blade 110 which contacts the intermediate transfer belt 61 while predetermined pressure is applied, and a support member 130 that supports the blade 110.

The blade 110 contacts the surface of the intermediate transfer belt 61, and blocks the surface such that remaining toners attached to the surface of the intermediate transfer belt 61 do not move beyond the blade 110 as the intermediate transfer belt 61 rotates. The blade 110 may comprise an elastomer material, for example, a urethane material.

One end of the blade 110 may be supported by the support member 130, and the other end may be arranged to contact the surface of the intermediate transfer belt 61.

An image area A defines an area on the intermediate transfer belt 61 to which a toner image may be transferred. The image forming apparatus 1 may intermediately transfer a toner image to the intermediate transfer belt 61, and afterwards, the image forming apparatus 1 may finally transfer the toner image to the paper S that is transferred between the final transfer roller 63 and the intermediate transfer belt 61. The image area A illustrated in FIG. 2 indicates a maximum range of a toner image that can be transferred on the intermediate transfer belt 61.

On the intermediate transfer belt 61, a non-image area C defines an area of the intermediate transfer belt 61 where no toner image is transferred. The non-image area C is an area excluding the image area A to which a toner image is transferred, and may correspond to an outside area at both ends of the image area A.

On the intermediate transfer belt 61, in addition to a toner image, a lubricating band B to accommodate an image for lubrication (or lubrication image), may be formed. The lubricating band B may function as a lubricant between the intermediate transfer belt 61 and the cleaning member 100, and reduce friction between the cleaning member 100 and the image carrier 61.

The image forming apparatus 1 may perform a lubricating operation of forming a toner image for lubrication (or lubrication toner image) on the image carrier 61 before printing the next page after completing printing of a page.

The exposure apparatus 30 may project light on the photosensitive drum and form an electrostatic latent image for lubrication (lubrication electrostatic latent image) in the form of a band in an axial direction of the photosensitive drum, and then the developing device may supply a toner to the electrostatic latent image for lubrication and form a lubricating band B (or lubrication band B) to which the electrostatic latent image for lubrication is transferred.

Some portions of the image for lubrication formed on the surface of the photosensitive drum may be transferred to the intermediate transfer belt 61 and form a lubricating band B on the intermediate transfer belt 61.

The lubricating band B formed on the photosensitive drum is removed by the cleaning member 100 as the photosensitive drum rotates. In such examples, the lubricating band B may function as a lubricant between the photosensitive drum and the cleaning member 100.

The lubricating band B formed on the intermediate transfer belt 61 is removed by the cleaning member 100 as the intermediate transfer belt 61 rotates. In such examples, the lubricating band B may function as a lubricant between the intermediate transfer belt 61 and the cleaning member 100.

The lubricating band B may be formed in the form of a band that extends along an axial direction of the intermediate transfer belt 61. The length of the lubricating band B formed in a longitudinal direction of the image carrier, may be the same as or longer than the length of the image area A in the longitudinal direction. The lubricating band B illustrated in FIG. 2 indicates a maximum range of an image for lubrication (or lubrication image range) that can be transferred on the intermediate transfer belt 61. When the image carrier is a photosensitive drum, the longitudinal direction corresponds to the direction of light projected onto the photosensitive drum. When the image carrier is the transfer belt, the longitudinal direction corresponds to a direction perpendicular to the proceeding direction (or conveying direction) of a printing paper (e.g., paper sheet S).

The length of the cleaning member 100 may be greater than the length of the lubricating band B. In this case, no lubrication image is applied between the outside area of the lubricating band B on the intermediate transfer belt 61 and the cleaning member 100, and thus a non-lubricated area of the intermediate transfer belt 61 may become damaged due to friction with the cleaning member 100 or the cleaning member 100 may flip for example, due to friction in the absence of lubrication.

In addition, no image for lubrication is transferred at the edge area of the intermediate transfer belt 61 which is a non-lubricated area. Accordingly, frictional force may be generated between the cleaning member 100 and the intermediate transfer belt 61, and due to increase of the torque of the intermediate transfer belt 61 according to the frictional force generated, the edge area of the intermediate transfer belt 61 which is a non-lubricated area may be broken, damaged or become worn out.

To prevent damage and wear in the edge area of the intermediate transfer belt 61, the cleaning member 100 may be formed, where its cleaning angles with the intermediate transfer belt 61 are set to cause a contact pressure at both ends of the cleaning member 100 to be less than a contact pressure in the other portions of the cleaning member 100. When the cleaning angle is reduced, the torque of the intermediate transfer belt 61 is reduced, and thus damage and wear in the edge area of the intermediate transfer belt 61 contacting both ends of the cleaning member 100 can be prevented or inhibited.

For example, both ends of the cleaning member 100 in the longitudinal direction may be formed to be bent toward the intermediate transfer belt 61.

For example, portions 113 of the cleaning member 100 which are bent toward the intermediate transfer belt 61 may be formed to have a length that substantially corresponds to the non-image area C, and the other portion 111 of the cleaning member 100 may be formed to have a length corresponding to the image area A.

For example, in the axial direction of the intermediate transfer belt 61, the image area A may have a length of 297 mm, and the lubricating band B may have a length of 313 mm. In this case, the blade 110 may be formed to have a length of 317 mm, and the portions 113 of the blade 110 bent in the direction of the intermediate transfer belt 61 (refer to FIG. 3) may have a length of 10 mm, and the other portion 111 (refer to FIG. 3) may have a length of 297 mm.

The specific configuration of the cleaning member 100 will be described in detail below.

In FIG. 2, an example wherein the cleaning member 100 is bent toward the intermediate transfer belt 61 was described. However, the disclosure is not limited thereto, and the cleaning member may be modified in numerous ways. In addition, a cleaning member arranged to contact the photosensitive drum may be formed to be bent toward the photosensitive drum.

In some examples, the cleaning member 100 may be formed such that the cleaning angles formed with the image carrier at both ends are greater than the cleaning angles formed with the image carrier in the other portions of the cleaning member 100, and for example, both portions 113 of the cleaning member 100 may be formed to be bent toward the image carrier.

Figure 3:
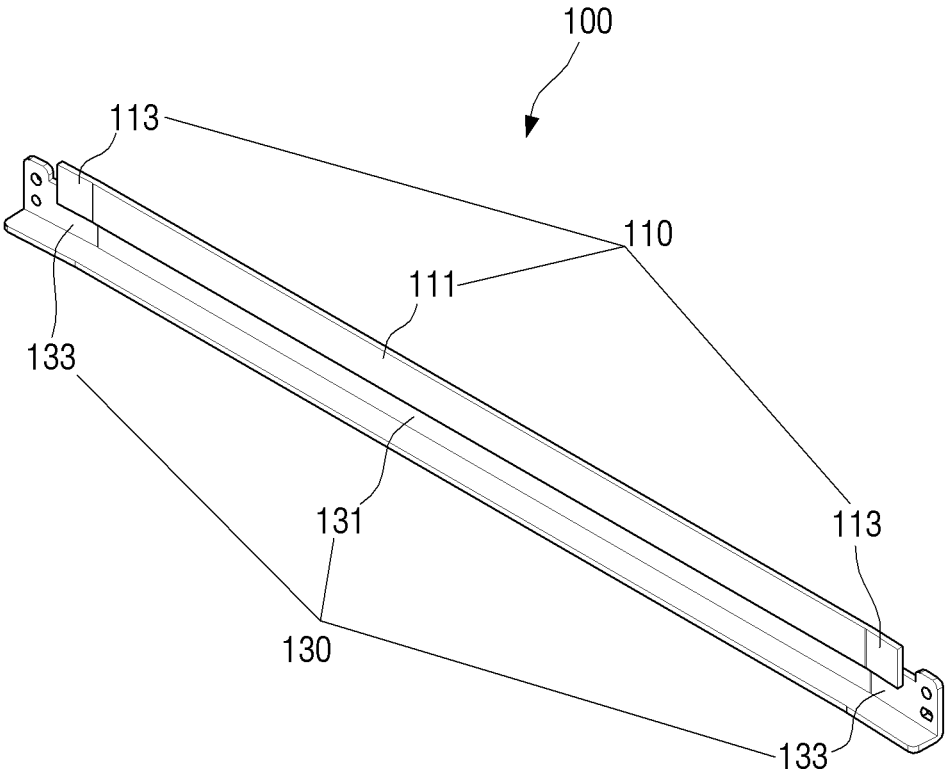
FIG. 3 is a perspective view of an example cleaning member.
Figure 4:
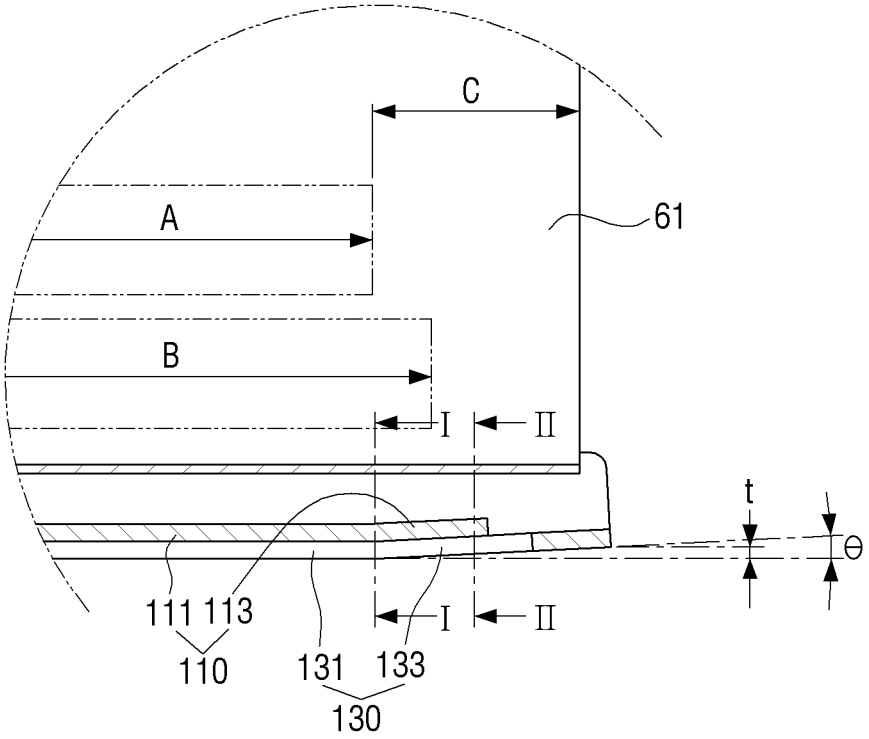
FIG. 4 is an enlarged view of a portion indicated by IV in FIG. 2.

FIG. 3 is a perspective view of an example cleaning member 100, and FIG. 4 is an enlarged view of a portion indicated by IV in FIG. 2.

Referring to FIGS. 3 and 4, the cleaning member 100 may include a blade 110 which contacts the image carrier 61 while predetermined pressure is applied, and a support member 130 which supports the blade 110.

The support member 130 may support the blade 110, and it may be fixed to the main body 10 of the image forming apparatus 1.

The blade 110 may contact the image carrier 61 and scrape off waste toners (or excess toner particles) that remain on the surface of the image carrier 61. In addition, the blade 110 may be attached on one surface of the support member 130.

The blade 110 may include a first portion 111 which is an intermediate portion (e.g., a main portion or center portion) along the longitudinal direction and a pair of second portions 113 which are located at the ends of the blade 110.

The support member 130 may include a first surface 131 supporting the first portion 111, and a second surface 133, which supports the second portion 113, is bent from both ends of the first portion 111.

The first portion 111 may extend in parallel with the image carrier 61, and, the second portion 113 may be bent from the first portion 111 toward the image carrier 61.

The second portion 113 may be formed to extend from the first portion 111 at a predetermined angle θ, with respect to the first portion 111. For example, the second portion 113 may form an angle θ of approximately 3° with the first portion 111.

In some examples, the second portion 113 may be located to contact the image carrier 61 more closely relative to the first portion 111. For example, the first portion 111 may extend from a first distal edge of the blade 110 toward the image carrier 61, in which the distal edge extends substantially parallel to the image carrier 61, and the second portion 113 may extend from a second distal edge toward the image carrier 61, such that the second distal edge has at least a portion that is located at a shorter distance to the image carrier 61 than a distance between the second distal edge and the image carrier 61. Accordingly, the second portion 113 contacts the image carrier 61 more closely relative to the first portion 111 contacting the image carrier 61. The first distal edge of the blade 110 may be substantially aligned with the first surface 131 of the support member 130 and the second distal edge of the blade 110 may be substantially aligned with the second surface 133 of the support member 130. In addition, in some examples, the first portion 111 may be spaced apart from the second portion 113, by a predetermined distance.

In some examples, the first surface 131 supporting the first portion 111 and the second surface 133 supporting the second portion 113 may be spaced apart by a distance t of approximately 0.5 mm.

In some examples, the second surface 133 of the support member 130 supporting the second portion 113 may be formed to extend from the first surface 131 of the support member 130 supporting the first portion 111 at a predetermined angle θ. In addition, the second surface 133 may be formed to be located in a closer position to the image carrier 61 than the position of the first surface 131.

One end of the blade 110 is fixed to the support member 130, for example, with an adhesive such as a double-sided tape, a thermal adhesive film, or a primer for adhesion.

In some examples, one end of the blade 110 is fixed to the support member 130, and the other end of the blade 110 that is not fixed is a free end, which may be elastically modified by external force. Accordingly, if the blade 110 is pressed to the surface of the image carrier 61, the other end of the blade 110 is modified, and depending on the amount of modification, regular contact pressure may be applied on the image carrier 61.

Figure 5:
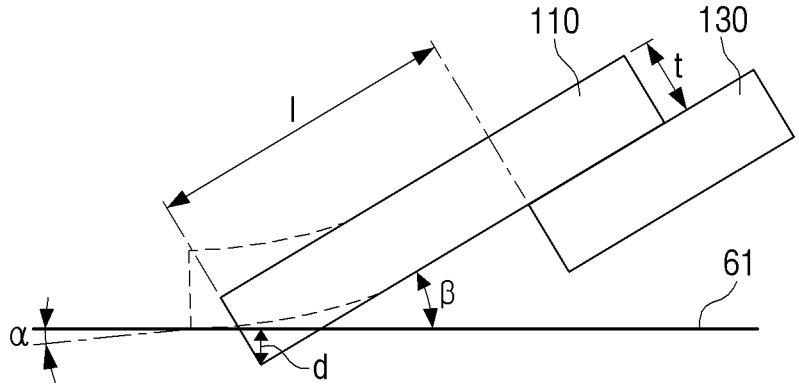
FIG. 5 is a schematic diagram illustrating a cleaning angle between a cleaning member and an image carrier according to an example of the disclosure.
Figure 6:
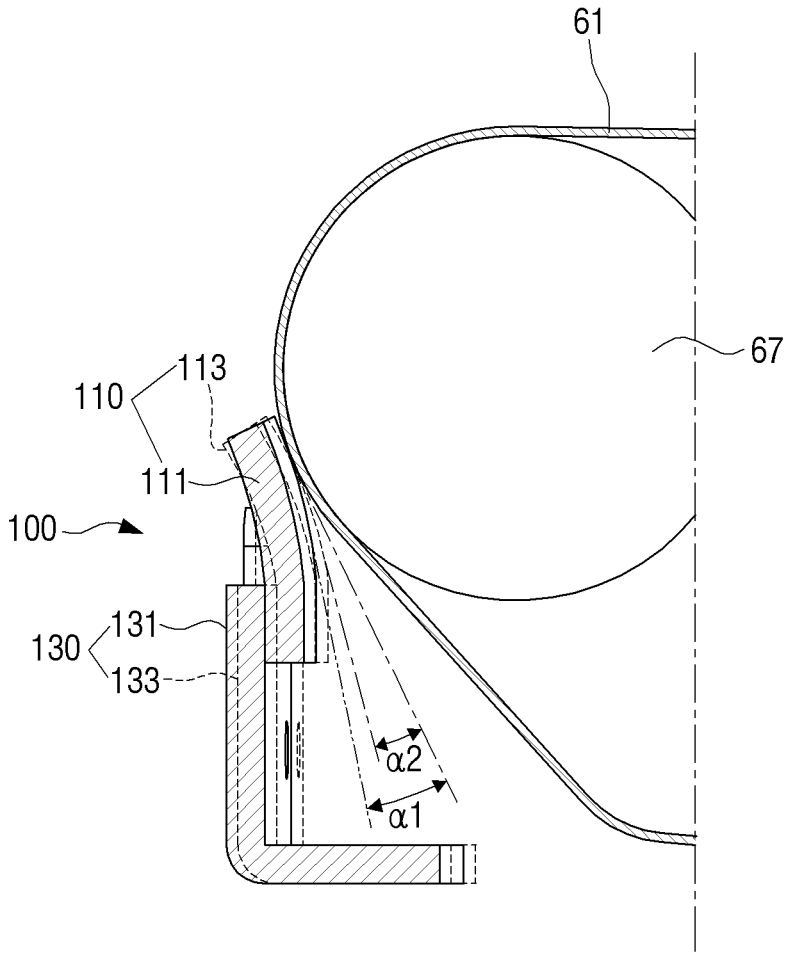
FIG. 6 is a cross-sectional view of the cleaning member and a portion of the intermediate transfer belt illustrated in FIG. 4, taken along the lines I-I and II-II.

With further reference to FIGS. 5 and 6, a first cleaning angle α1 between the first portion 111 of the blade 110 and the image carrier 61 is greater than a second cleaning angle α2 between the second portion 113 of the blade 110 and the image carrier 61.

The second portion 113 may be formed to have a length corresponding to the non-image area C. Also, the second portion 113 may be formed to be bent from the first portion 111 in an area wherein the non-image area C and the lubricating band B overlap with each other.

The length of the first portion 111 in the longitudinal direction may be formed to be the same as or longer than the length of the image area A, and the length of the second portion 113 in the longitudinal direction may be formed to be the same as or longer than the length of the lubricating band B.

In an example where the image area A extends along a length of 297 mm, and the lubricating band B extends along a length of 313 mm, the blade 110 may be formed as 317 mm, the first portion 111 may be formed as approximately 297 mm to correspond to the image area A, and the second portion 113 may be formed as approximately 10 mm.

The second portion 113 may be arranged to be adjacent to the image carrier 61, and reduce the cleaning angle α formed with the image carrier 61, and thereby reduce the torque of the image carrier 61 in the non-image area C wherein an image for lubrication is not formed. Accordingly, damage and wear in the edge area of the intermediate transfer belt 61 which is a non-lubricated area can be prevented or inhibited.

FIG. 5 is a schematic diagram for illustrating a cleaning angle between a cleaning member and an image carrier according to an example of the disclosure.

The cleaning angle α refers to an angle between the blade 110 modified by pressure and the image carrier 61. An overlapping amount d may represent a theoretical depth by which the blade 110 would extend beyond the image carrier 61. A set angle β refers to an angle between the blade 110 and the image carrier 61. The cleaning angle α may be determined based on the overlapping amount d of the blade 110 with the image carrier 61 and the set angle β of the blade 110 according to the Formula 1 below.

$$\alpha=\beta-\arctan((3/2)*(d/l)) \quad \text{[Formula 1]}$$

wherein α refers to the cleaning angle, β refers to the set angle, and d refers to the overlapping amount of the blade with the image carrier.

The cleaning angle α is a value which is a result of multiplying 3/2 with a value resulting from dividing the overlapping amount d of the blade 110 and the image carrier 61 by the length l of the free end, obtaining an arctangent value of the multiplication result, and then subtracting the arctangent value from the set angle β of the blade 110.

The cleaning angle α may decrease as the overlapping amount d of the blade 110 and the image carrier 61 increases, and may increase as the overlapping amount d of the blade 110 and the image carrier 61 decreases.

Here, the overlapping amount d of the blade 110 and the image carrier 61 may be determined according to Formula 2.

$$d=N*l^3/(3*E*t) \quad \text{[Formula 2]}$$

wherein d refers to the overlapping amount, N refers to an elastic force, l refers to the length of the free end of the blade, E refers to the Young's modulus, and t refers to the thickness of the blade.

The overlapping amount d of the blade 110 and the image carrier 61 refers to the depth of the overlapping portion of the blade 110 having elasticity with the image carrier 61. Also, the overlapping amount d of the blade 110 and the image carrier 61 is a value which is a result of multiplying the elastic force N and the cube of the length l of the free end of the blade 110, and then dividing the multiplied value by a product of the Young's modules E, multiplied by the thickness t of the blade 110, multiplied by 3.

In the cleaning member 100 according to an example of the disclosure, the support member 130 of the non-image area C is formed in a shape of being bent toward the image carrier 61, and accordingly, both ends of the blade 110 are formed to be bent toward the image carrier 61, and the cleaning angle α of the non-image area C is formed to be less than the cleaning angles of the other areas, and thus durability and reliability of the image carrier 61 can be enhanced.

FIG. 6 is a cross-sectional view illustrating the cut sections taken along the lines I-I' and II-II' indicated in FIG. 4.

Referring to FIG. 6, the section cut along I-I' is a cross-sectional view of the first portion 111 and was illustrated in a full line, and the section cut along II-II' is a cross-sectional view of the second portion 113 and was illustrated in a dotted line.

Referring to the cross-sectional view of the first portion 111 illustrated in a full line, the first portion 111 and the intermediate transfer belt 61 may contact each other at a first contact pressure. Also, the first portion 111 and the intermediate transfer belt 61 may contact each other to have a first cleaning angle α1.

As the first portion 111 contacts the image area A of the intermediate transfer belt 61 and an area wherein the lubricating band B is formed, a lubrication operation between the first portion 111 and the intermediate transfer belt 61 becomes possible. Accordingly, the first cleaning angle α1 between the first portion 111 and the intermediate transfer belt 61 may be set such that the blade 110 can easily remove a remaining image in a high temperature, high humidity environment, an office environment, and a low temperature environment.

For example, in the first portion 111, the first cleaning angle α1 may be set to be relatively large, and accordingly, the cleaning property of the blade 110 can be improved.

Meanwhile, referring to the dotted line illustrating the cross-sectional view of the second portion 113, the second portion 113 and the intermediate transfer belt 61 may contact each other at second contact pressure. Also, the second portion 113 and the intermediate transfer belt 61 may contact each other to have a second cleaning angle α2.

If the second cleaning angle α2 is reduced, the torque of the edge area of the intermediate transfer belt 61 contacting the second portion 113 is decreased, and thus damage and wear of the intermediate transfer belt 61 can be reduced. In addition, the edge of the intermediate transfer belt 61 is a non-lubricated area, and accordingly the edge of intermediate transfer belt 61 does not receive any toner nor any lubricating band. Therefore, friction between the intermediate transfer belt 61 and the blade 110 is increased. Thus, to reduce the torque of the edge area of the intermediate transfer belt 61, the second portion 113 may be formed to contact the image carrier 61 more closely relative to the first portion 111.

As the second portion 113 is formed to contact the image carrier 61 more closely, relative to the contact between the first portion 111 and the image carrier 61, the overlapping amount with the intermediate transfer belt 61 in the second portion 113 is greater than the overlapping amount with the intermediate transfer belt 61 in the first portion 111.

The second cleaning angle α2 in the second portion 113 may be less than the first cleaning angle α1 in the first portion 111.

As the cleaning angle is reduced while the overlapping amount of the blade 110 and the intermediate transfer belt 61 is the same, the torque of the intermediate transfer belt 61 decreases more, and thus the cleaning torque that is generated during cleaning may be reduced.

For example, in a case where the cleaning angle is 12.1°, the torque of the intermediate transfer belt 61 is 342 g/cm, and the cleaning torque is measured as 67 g/cm. In another example where the cleaning angle is 11.6°, the torque of the intermediate transfer belt 61 is 335 g/cm, and the cleaning torque is measured as 60 g/cm. In another example where the cleaning angle is 8.4°, the torque of the intermediate transfer belt 61 is 332 g/cm, and the cleaning torque is measured as 57 g/cm. In another example where the cleaning angle is 4.3°, the torque of the intermediate transfer belt 61 is 332 g/cm, and the cleaning torque is measured as 30 g/cm. In another example without any cleaning member, the torque of the intermediate transfer belt 61 is 275 g/cm, and the cleaning torque is measured as 0 g/cm.

Through the above results, it can be figured out that the cleaning torque is reduced as the cleaning angle becomes smaller.

That is, as the cleaning torque in the second portion 113 contacting the non-lubricated area is smaller than the cleaning torque in the first portion 111, damage and wear in the edge area of the intermediate transfer belt 61 can be reduced.

The overlapping amount of the second portion 113 is greater than the overlapping amount of the first portion 111. Accordingly, the second contact pressure in the second portion 113 may be greater than the first contact pressure in the first portion 111.

Accordingly, the second cleaning angle α2 in the second portion 113 may be relatively small, but the second contact pressure with the intermediate transfer belt 61 in the second portion 113 may be relatively high, and thus the cleaning property of the second portion 113 can be enhanced.

The cleaning member 100 may include a second portion 113 which has a relatively small cleaning angle with the image carrier 61 on at both ends of the cleaning member 100, and may thereby prevent damage and wear of the image carrier 61 in the non-lubricated area. Further, the second portion 113 may be advantageous for preventing damage and wear of the intermediate transfer belt 61 in a high temperature, high humidity environment wherein the torque of the intermediate transfer belt 61 increases.

Figure 7:
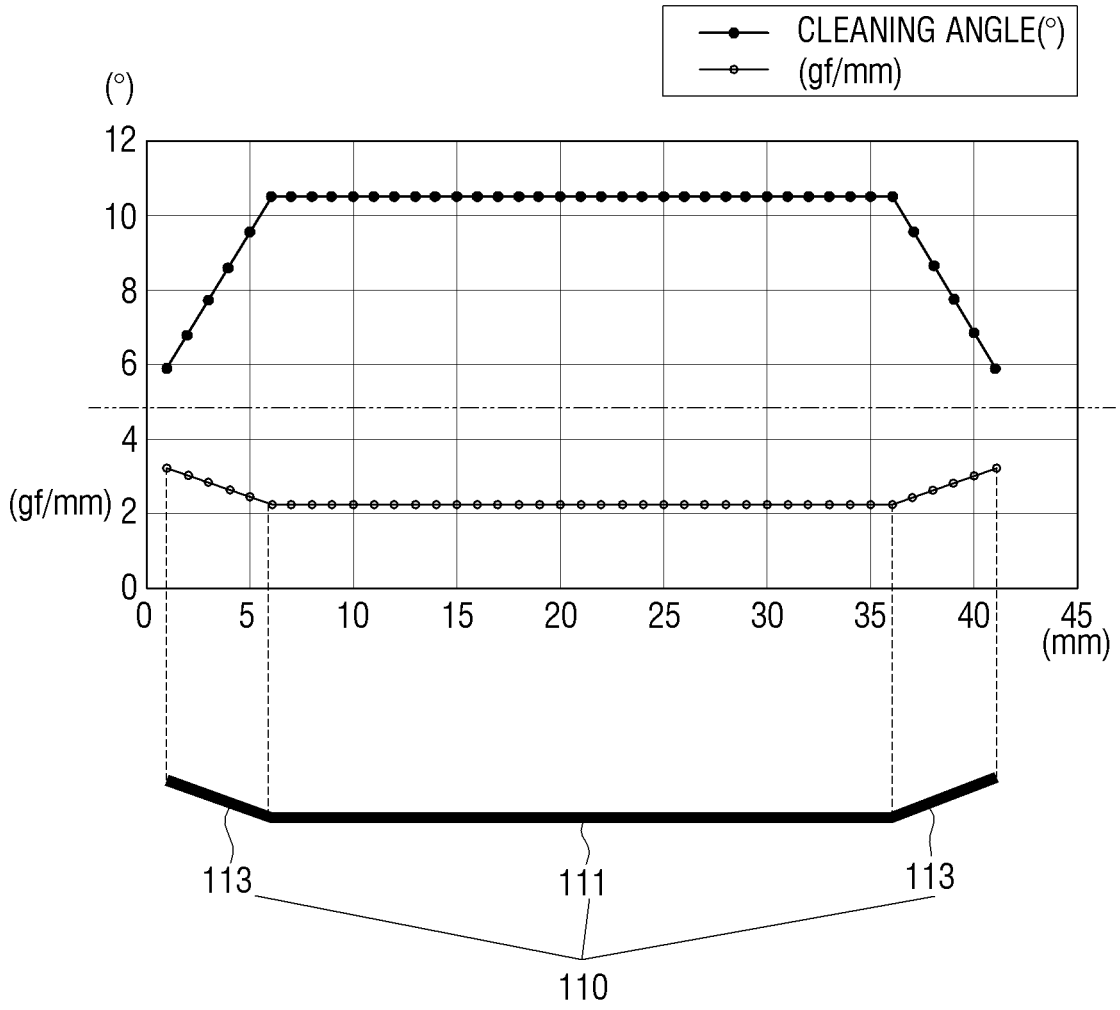
FIG. 7 is a graph illustrating line pressure and cleaning angles according to each point of an example cleaning member.

FIG. 7 is a graph illustrating line pressure and cleaning angles according to each point of an example cleaning member.

Referring to FIG. 7, it is apparent that the cleaning angle and the line pressure between the cleaning member and the image carrier change according to the shape of the blade 110.

Referring to the graph of cleaning angles, the first portion 111 may be formed to have a cleaning angle approximately equal to or less than 11° with the image carrier 61.

The second portion 113 may be formed to have a cleaning angle within a range of approximately equal to or less than 11°, and equal to or greater than 5° with the image carrier 61. Specifically, in the second portion 113, both ends of the blade 110 which are closest to the image carrier 61 may be formed to have a cleaning angle approximately equal to or less than 6°, with the image carrier 61.

The blade 110 may be formed such that the cleaning angle decreases from the first portion 111 to the second portion 113. The cleaning torque may be decreased by forming the cleaning angle to be smaller at the ends of the blade 110. Although the second portion 113 contacts the non-lubricated area of the image carrier 61, the cleaning torque is low, and thus a phenomenon where the image carrier 61 is damaged due to friction or the cleaning member 100 may flip due to friction in the absence of lubrication may not occur.

Referring to the graph line of the line pressure, the first portion 111 may be formed to have line pressure of approximately 2 gf/mm with the image carrier 61, and the second portion 113 may be formed to have line pressure within a range of approximately equal to or greater than 2 gf/mm and equal to or less than 4 gf/mm with the image carrier 61.

As the second portion 113 contacting the non-image area C is formed to extend closer to the image carrier 61, the cleaning angle between the blade 110 and the image carrier 61 in the non-image area C is relatively small, and the line pressure is relatively large. Accordingly, the cleaning torque applied to the ends of the image carrier 61 is low, and thus breakage, damage, and abrasion on both ends of the image carrier 61 can be prevented or inhibited.

In some examples of the cleaning member 100, both ends of the blade 110 may be formed to be bend toward the image carrier 61, and thus the overlapping amount with the image carrier 61 on both ends of the blade 110 may be changed. For example, both ends of the blade 110 may include the second portion 113 formed to bent in the direction of the image carrier 61, and the overlapping amount with the image carrier 61 in the second portion 113 may be formed to be greater than the overlapping amount with the image carrier 61 in the first portion 111 that extends parallel with the image carrier 61.

As the overlapping amount of the second portion 113 is formed to be greater, the second cleaning angle $\alpha 2$ and the second contact pressure in the second portion 113 may be different from the first cleaning angle $\alpha 1$ and the first contact pressure in the first portion 111.

For example, the cleaning angle $\alpha 2$ of the second portion 113 at both ends of the blade 110 may be less than the cleaning angle $\alpha 1$ of the first portion 111 at the center portion of the blade 110, and the first contact pressure may be less than the second contact pressure.

As described above, for the first portion 111 that contacts the image area A of the image carrier 61, the cleaning angle is formed to improve the cleaning property, and for the second portion 113 that contacts the non-image area C of the image carrier 61, the cleaning angle is formed to improve on durability and abrasion and prevention of a flipping phenomenon of the cleaning member, and accordingly, to prevent or inhibit breakage and abrasion at the ends of the image carrier, and to further prevent or inhibit a flipping phenomenon of the cleaning member. Through this, the lifespan of the image carrier and the cleaning member is increased, and reliability of the cleaning property of the cleaning member can thereby be enhanced.

It is to be understood that not all aspects, advantages and features described herein may necessarily be achieved by, or included in, any one particular example. Indeed, having described and illustrated various examples herein, it should be apparent that other examples may be modified in arrangement and detail.

What is claimed is:

1. An image forming apparatus comprising:

an image carrier;

a developing device to supply a toner to the image carrier; and a cleaning member including a blade that contacts the image carrier and that applies a pressure onto the image carrier, wherein two ends of the blade are bent in a direction toward the image carrier, and wherein cleaning angles formed by the blade with the image carrier at the two ends of the blade are smaller than cleaning angles formed by the blade with the image carrier in other portions of the blade located between the two ends.

2. The image forming apparatus of claim 1, wherein the blade extends in a longitudinal direction and includes a first portion that is in parallel with the image carrier along the longitudinal direction of the blade, and a second portion extending from one of the two ends of the first portion, wherein the second portion is bent relative to the first portion, and wherein the second portion contacts the image carrier more closely than the first portion.

3. The image forming apparatus of claim 2, wherein a contact pressure between the first portion and the image carrier is less than a contact pressure between the second portion and the image carrier.

4. The image forming apparatus of claim 2, wherein an overlapping amount between the first portion and the image carrier is less than an overlapping amount between the second portion and the image carrier.

5. The image forming apparatus of claim 2, wherein the developing device is to form a lubrication image with the toner, on the image carrier, wherein the image carrier has an image area to form a toner image, and wherein the lubrication image has a length greater than a length of the image area of the image carrier.

6. The image forming apparatus of claim 5, wherein the first portion of the blade has a length that is equal to or greater than a length of the image area.

7. The image forming apparatus of claim 5, wherein the image carrier has a non-image area located outside the image area, and wherein the second portion of the blade has a length that is equal to or less than a length of a non-image area.

8. The image forming apparatus of claim 7, wherein the length of the second portion of the blade is equal to or greater than a length of a lubrication image range on the image carrier.

9. The image forming apparatus of claim 2, wherein the cleaning member includes a support member supporting the blade, and wherein the support member comprises:

a first surface supporting the first portion, and a second surface that is bent at a predetermined angle from one of the two ends of the first portion, and supports the second portion.

10. The image forming apparatus of claim 9, wherein a distance between the first surface and the image carrier is greater than a distance between the second surface and the image carrier.

11. The image forming apparatus of claim 9, wherein the angle between the first surface and the second surface is 3 degrees.

12. A cleaning member comprising:

a blade that contacts an image carrier to remove a toner from the image carrier, wherein the blade forms cleaning angles with the image carrier; and a support member to support the blade, wherein the support member has two ends which are bent toward the image carrier, and wherein the cleaning angles of the blade formed with the image carrier at the two ends of the blade are smaller than the cleaning angles of the blade formed with the image carrier in other portions of the blade.

13. The cleaning member of claim 12, wherein the blade extends in a longitudinal direction, wherein the blade includes a first portion that extends parallel with the image carrier along the longitudinal direction of the blade, and a second portion extending from one of the two ends of the first portion, wherein the second portion is bent relative to the first portion, and wherein the second portion contacts the image carrier more closely than the first portion.

14. The cleaning member of claim 13, wherein the cleaning angle between the first portion and the image carrier is greater than the cleaning angle between the second portion and the image carrier.

15. The cleaning member of claim 13, wherein an overlapping amount between the first portion and the image carrier is less than an overlapping amount between the second portion and the image carrier.

* * * * *